US009951724B2

(12) United States Patent
Cho

(10) Patent No.: US 9,951,724 B2
(45) Date of Patent: Apr. 24, 2018

(54) HEAT EXCHANGER HAVING WAVE FIN PLATE FOR REDUCING EGR GAS PRESSURE DIFFERENCE

(71) Applicant: KORENS CO., LTD., Yangsan (KR)

(72) Inventor: Yong Kuk Cho, Busan (KR)

(73) Assignee: KORENS CO., LTD., Yangsan-si (KR)

( * ) Notice: Subject to any disclaimer, the term of this patent is extended or adjusted under 35 U.S.C. 154(b) by 0 days.

(21) Appl. No.: 15/313,609

(22) PCT Filed: Jun. 19, 2014

(86) PCT No.: PCT/KR2014/005432

§ 371 (c)(1),
(2) Date: Nov. 23, 2016

(87) PCT Pub. No.: WO2015/190635

PCT Pub. Date: Dec. 17, 2015

(65) Prior Publication Data

US 2017/0184060 A1 Jun. 29, 2017

(30) Foreign Application Priority Data

Jun. 13, 2014 (KR) ..... 10-2014-0072200

(51) Int. Cl.
*F28F 9/02* (2006.01)
*F02M 26/32* (2016.01)
(Continued)

(52) U.S. Cl.
CPC ..... *F02M 26/32* (2016.02); *F28F 1/325* (2013.01); *F28F 3/025* (2013.01)

(58) Field of Classification Search
CPC .... F28F 1/325; F28F 3/025; F28F 3/06; F28F 3/08; F28D 7/1684; F28D 21/0003;
(Continued)

(56) References Cited

U.S. PATENT DOCUMENTS

2005/0144931 A1* 7/2005 Floyd ..... F02C 6/18 60/39.511
2007/0235164 A1* 10/2007 Miyagawa ..... F01N 5/02 165/104.14
(Continued)

FOREIGN PATENT DOCUMENTS

JP 2004-177061 6/2004
JP 2004-263616 9/2004
(Continued)

*Primary Examiner* — Davis Hwu
(74) *Attorney, Agent, or Firm* — Lex IP Meister, PLLC

(57) ABSTRACT

Disclosed is a heat exchanger including: a heat exchanger body; a gas inlet for introducing exhaust gas into the heat exchanger body; a coolant inlet for introducing a coolant into the heat exchanger body; a gas outlet for discharging the exhaust gas that is cooled by heat exchange with the coolant; and a coolant outlet for discharging the coolant that completes heat exchange with the exhaust gas. In this case, the heat exchanger body includes: a laminated tube core formed by laminating a plurality of gas channels side by side; a housing formed so as to enclose the laminated tube core except for opposite ends thereof; and a wave fin plate integrally provided with a plurality of wave fins and arranged within each of the gas channels, wherein each of the wave fins includes a fixed pitch section, and a variable pitch section.

11 Claims, 8 Drawing Sheets

(51) Int. Cl.
*F28F 3/02* (2006.01)
*F28F 1/32* (2006.01)

(58) Field of Classification Search
CPC ..... F28D 9/0043; F01N 5/02; F01N 2240/02; F02M 26/32
USPC ..... 165/174
See application file for complete search history.

(56) References Cited

U.S. PATENT DOCUMENTS

2008/0011464 A1* 1/2008 Oofune ..... F28D 7/1684 165/157
2012/0017575 A1* 1/2012 Sloss ..... F01N 5/02 60/320

FOREIGN PATENT DOCUMENTS

JP 2005-180268 7/2005
JP 2013-088078 5/2013
KR 10-0814073 3/2008

* cited by examiner

R2 = A x R1 (A = 1.5 ~ 3)

HEAT EXCHANGER HAVING WAVE FIN PLATE FOR REDUCING EGR GAS PRESSURE DIFFERENCE

TECHNICAL FIELD

The present invention relates generally to a heat exchanger having a wave fin plate for reducing an EGR gas pressure difference. More particularly, the present invention relates to a heat exchanger capable of reducing gas pressure difference considerably by using a wave fin plate that includes a fixed pitch section adjacent to a position of a gas inlet, and a variable pitch section adjacent to a position of a gas outlet.

BACKGROUND ART

In general, an exhaust gas recirculation (EGR) system increases concentration of $CO_2$ in intake air by recirculating a portion of exhaust gas to an intake system, thereby decreasing temperature of a combustion chamber, and thus reducing NOx.

An exhaust gas heat exchanger (normally referred to as an EGR cooler) for cooling the exhaust gas by using a coolant is used in the EGR system. Since the exhaust gas heat exchanger cools exhaust gas temperature from about 700° C. to 150~200° C., it is required to have heat resistance. Further, the exhaust gas heat exchanger is required to be compact so as to be mounted to a vehicle, and to minimize pressure reduction for supplying a proper amount of EGR. Additionally, when the exhaust gas is condensed during heat exchange, sulphur oxides are included in condensed water due to sulphur in the exhaust gas, which causes the exhaust gas heat exchanger to be easily corroded, and thus the exhaust gas heat exchanger is required to be corrosion-resistant. Further, since mechanical loads occur due to pulsation of the exhaust gas, the exhaust gas heat exchanger is required to have a predetermined mechanical strength.

The exhaust gas heat exchanger includes: a laminated tube core in which a plurality of gas channels are laminated; an exhaust gas passage through which the exhaust gas passes in each of the gas channels; and a coolant passage provided between adjacent gas channels. Further, the gas channel of the exhaust gas heat exchanger is provided with a fin structure, that is, a wave fin plate therein that can increase heat exchange efficiency by inducing turbulence of fluid. The wave fin plate normally referred to as a wavy fin includes a plurality of wave fins, and each of the wave fins has a sine curve shape of a fixed pitch that has a ridge shape and a groove shape arranged in series in an entire length of each of the wave fins.

As shown above, the sine curve shape of the wave fin having the fixed pitch causes turbulence in fluid, that is, the exhaust gas that passes through a fluid passage having the wave fin, thereby increasing heat exchange efficiency of the exhaust gas heat exchanger. Meanwhile, although a performance and the gas pressure difference reduction of an EGR cooler required when developing a vehicle depend on an engine of the vehicle, improved performance (or efficiency), and a gas pressure difference reduction are required in any kind of engine. However, the wave fin plate that includes wave fins having a fixed pitch sine curve shape has difficulty in maintaining efficiency and reducing the gas pressure difference.

DISCLOSURE

Technical Problem

Accordingly, the present invention has been made keeping in mind the above problems occurring in the related art, and the present invention is intended to propose a heat exchanger, whereby the heat exchanger maintains efficiency and considerably reduces a gas pressure difference by using a wave fin plate that includes a fixed pitch section adjacent to a position of a gas inlet and a variable pitch section adjacent to a position of a gas outlet.

Technical Solution

In order to achieve the above object, according to one aspect of the present invention, there is provided a heat exchanger including: a heat exchanger body; a gas inlet for introducing exhaust gas into the heat exchanger body; a coolant inlet for introducing a coolant into the heat exchanger body; a gas outlet for discharging the exhaust gas that is cooled by heat exchange with the coolant; and a coolant outlet for discharging the coolant that completes heat exchange with the exhaust gas, wherein the heat exchanger body comprises: a laminated tube core formed by laminating a plurality of gas channels side by side; a housing formed so as to enclose the laminated tube core except for opposite ends thereof; and a wave fin plate integrally provided with a plurality of wave fins and arranged within each of the gas channels, the wave fins having a wave fin of a ∪-shaped cross-section and a wave fin of a ∩-shaped cross-section that are arranged in series along a width direction of the wave fin plate, wherein each of the wave fins includes a fixed pitch section adjacent to a position of the gas inlet, and a variable pitch section adjacent to a position of the gas outlet along a longitudinal direction of the wave fin, each of pitches within the variable pitch section of the wave fin being always greater than each of pitches within the fixed pitch section of the wave fin, and the variable pitch section occupying 10 to 60% of a total length of the wave fin plate.

According to an embodiment of the present invention, in each of the wave fins, a first pitch of the variable pitch section may be 1.1 to 2.5 times greater than a fixed pitch of the fixed pitch section.

According to the embodiment of the present invention, the pitch of the variable pitch section of the wave fin may be configured to gradually increase as the pitch of the variable pitch section approaches a position of the gas outlet.

According to the embodiment of the present invention, the pitches of the variable pitch section of the wave fin may be configured to be same each other.

According to the embodiment of the present invention, the pitch of the variable pitch section of the wave fin may be configured to gradually decrease as the pitch of the variable pitch section approaches a position of the gas outlet.

According to the embodiment of the present invention, the wave fin may include: a first waveform part, and a second waveform part positioned to follow the first waveform part in series such that the second waveform part defines a predetermined pitch between the first waveform part and the second waveform part, the first waveform part having a first curvature radius, and the second waveform part having a second curvature radius 1.5 to 3 times greater than the first curvature radius.

According to the embodiment of the present invention, each of the wave fins may be configured to have a predetermined height of 4 to 8 mm.

According to the embodiment of the present invention, each of the wave fins may be configured to be within 3 to 8 mm in all of the pitches.

According to the embodiment of the present invention, the wave fin plate may be formed of a metal plate by forming selected from press forming, gear forming, and a combination thereof, and may be integrally joined to the laminated tube core therein by joining selected from welding, soldering, adhesion, and a combination thereof.

According to the embodiment of the present invention, the metal plate forming the wave fin plate may be made of an austenitic stainless steel of any one selected from SUS 304, SUS 304L, SUS 316, and SUS 316L, and may have a thickness of 0.05 to 0.3 mm.

Advantageous Effects

According to the present invention having the above-described characteristics, it is possible to realize a heat exchanger, whereby the heat exchanger can maintain efficiency, and considerably reduce a gas pressure difference by using a wave fin plate that includes a wave fin having a variable pitch section. Particularly, when a length of the variable pitch section occupies 10 to 60% of a total length of the wave fin, the heat exchanger can considerably reduce the gas pressure difference and maintain efficiency. In addition, since a first pitch of the variable pitch section of the wave fin is limited to 1.1 to 2.5 times greater than a pitch of a fixed pitch section of the wave fin, the heat exchanger can further minimize efficiency reduction.

MODE FOR INVENTION

Figure 1:
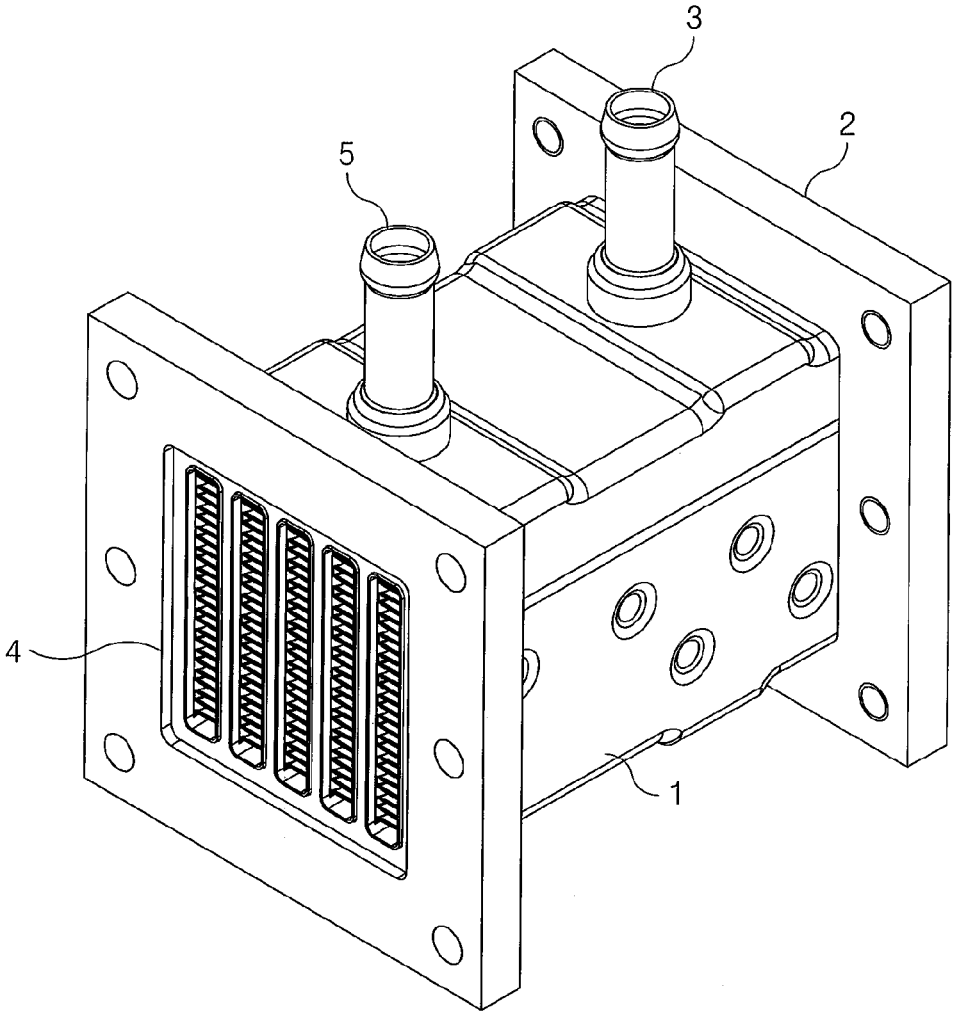
FIG. 1 is a perspective view for describing an exhaust gas heat exchanger for an EGR system according to an embodiment of the present invention.

Reference will now be made in greater detail to an exemplary embodiment of the present invention, an example of which is illustrated in the accompanying drawings. The embodiment of the present invention disclosed herein is only for illustrative purposes such that the spirit of the present invention can be sufficiently delivered to those skilled in the art. Therefore, the present invention is not limited to the embodiment described hereinbelow, and may be embodied in many different forms. In the drawings, width, length, and thickness of components may be exaggerated for convenience.

Figure 2:
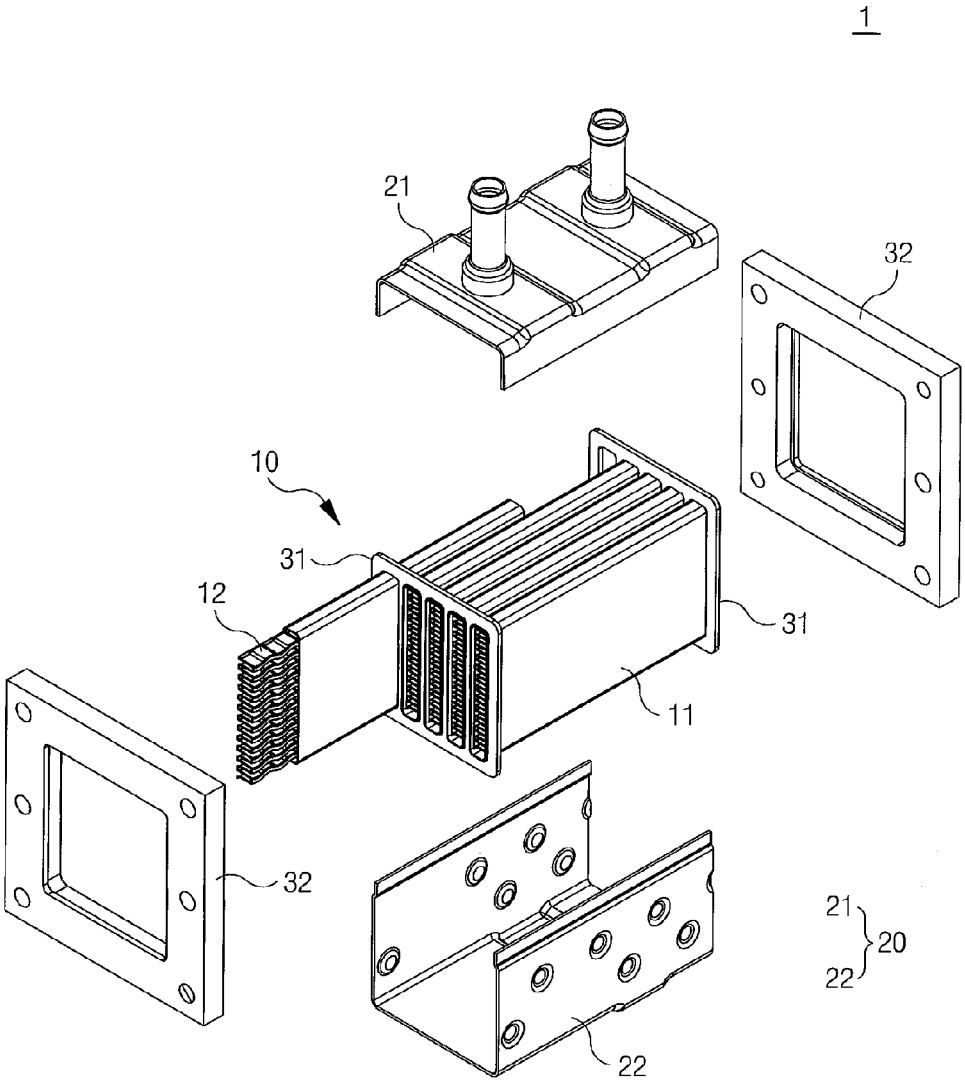
FIG. 2 is an exploded perspective view of a heat exchanger body shown in FIG. 1.
Figure 3:
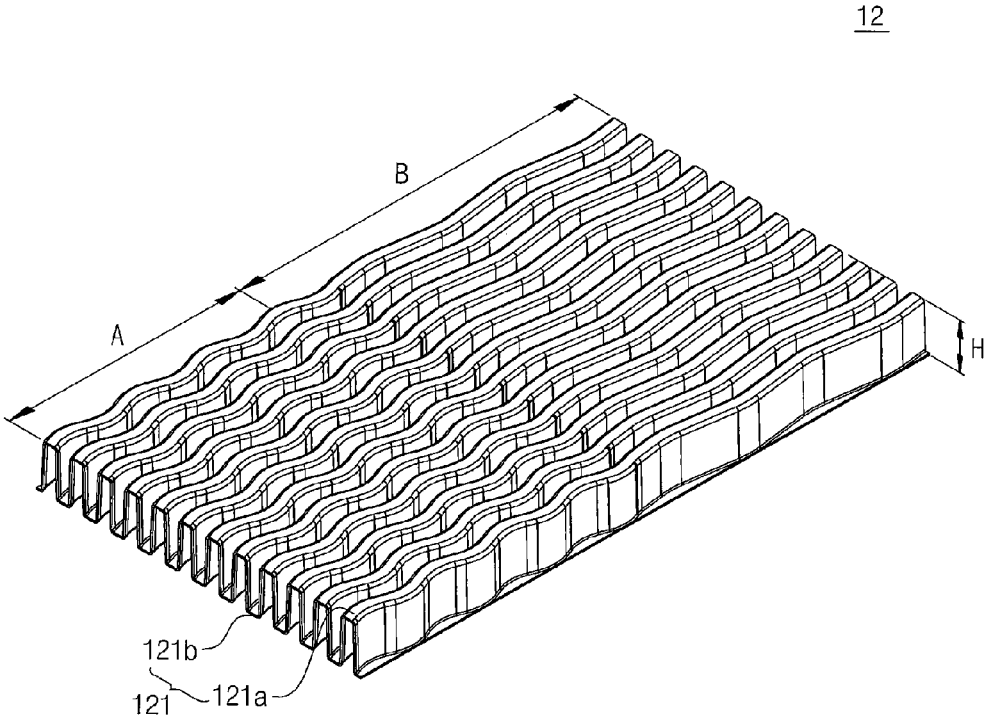
FIG. 3 is an enlarged perspective view of a wave fin plate removed from the heat exchanger body shown in FIG. 2.
Figure 4A:
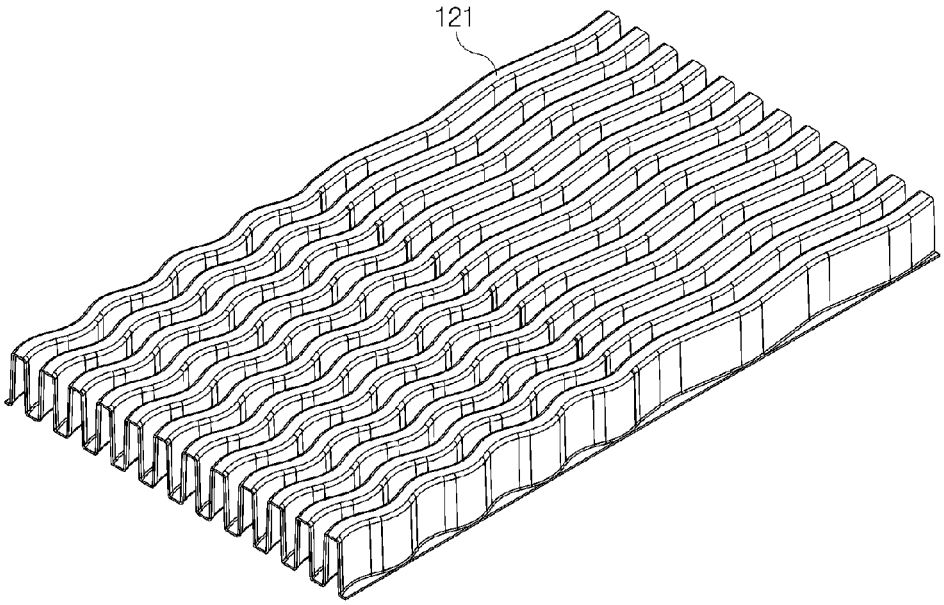
FIGS. 4(*a*) and 4(*b*) are perspective views for comparatively describing the wave fin plate that includes a wave fin having a variable pitch section according to the embodiment of the present invention, and a wave fin plate that includes a wave fin having fixed pitches according to the related art.
Figure 4B:
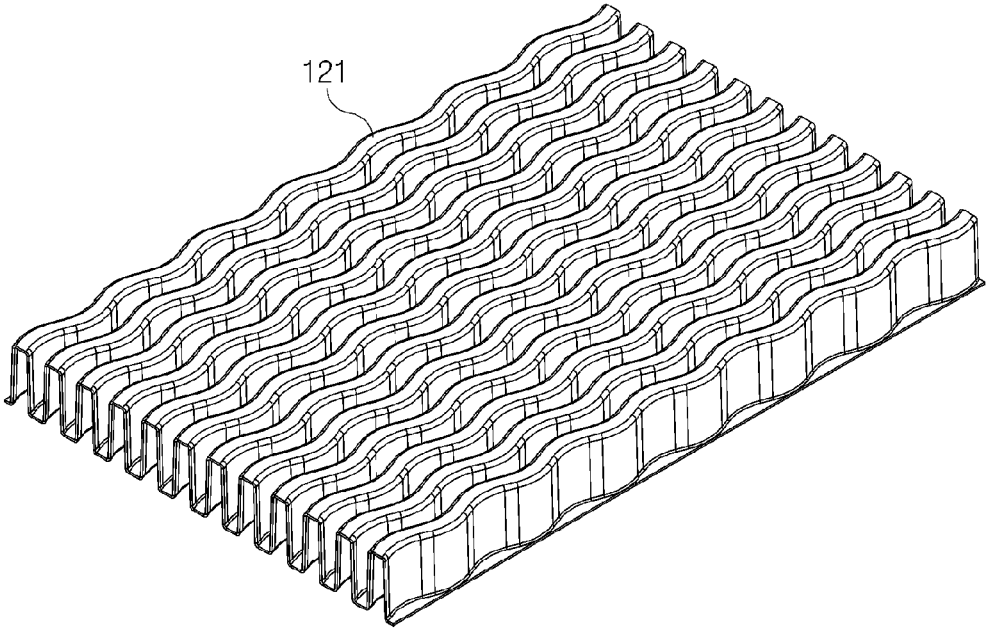
Figure 5:
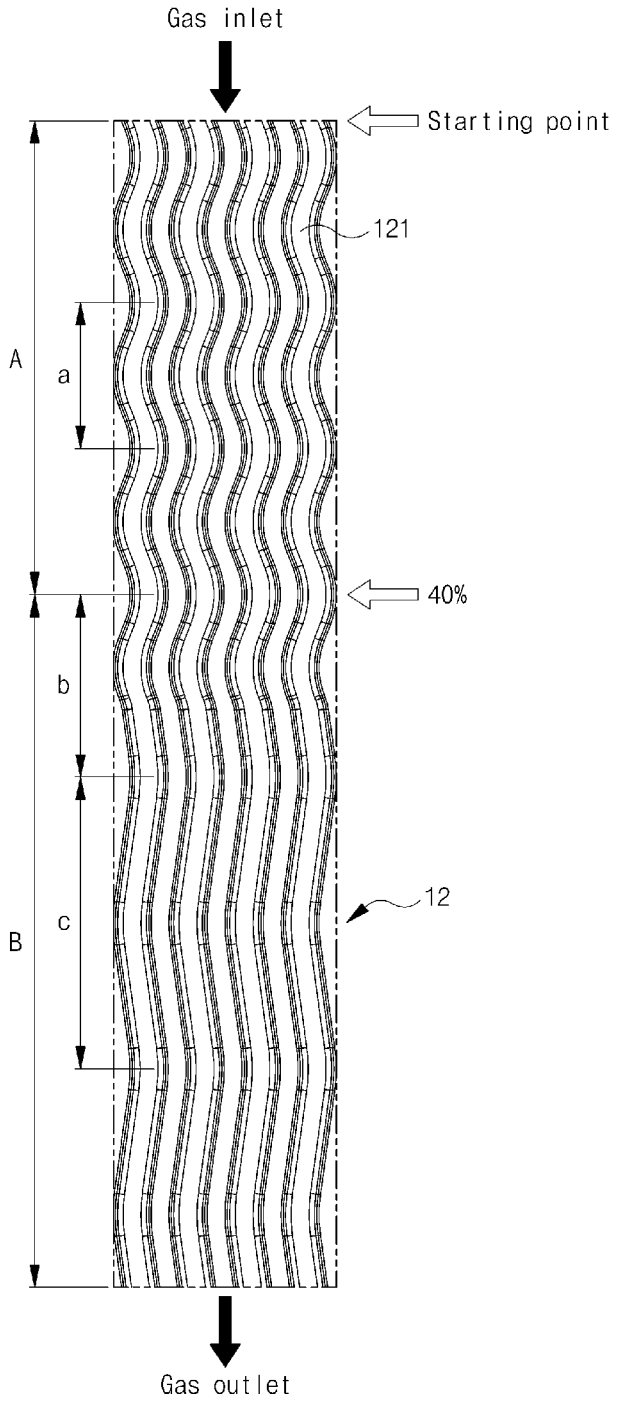
FIG. 5 is a view showing a fixed pitch section of the wave fin plate and the variable pitch section according to the embodiment of the present invention.
Figure 6:
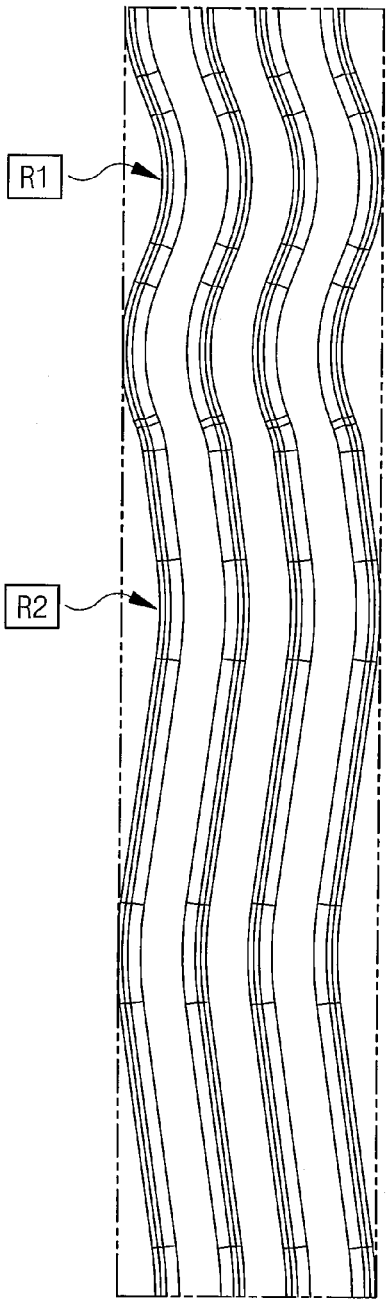
FIG. 6 is a view for describing a relation between curvature radii of adjacent waveform parts within the variable pitch section of the wave fin plate according to the embodiment of the present invention.
Figure 7:
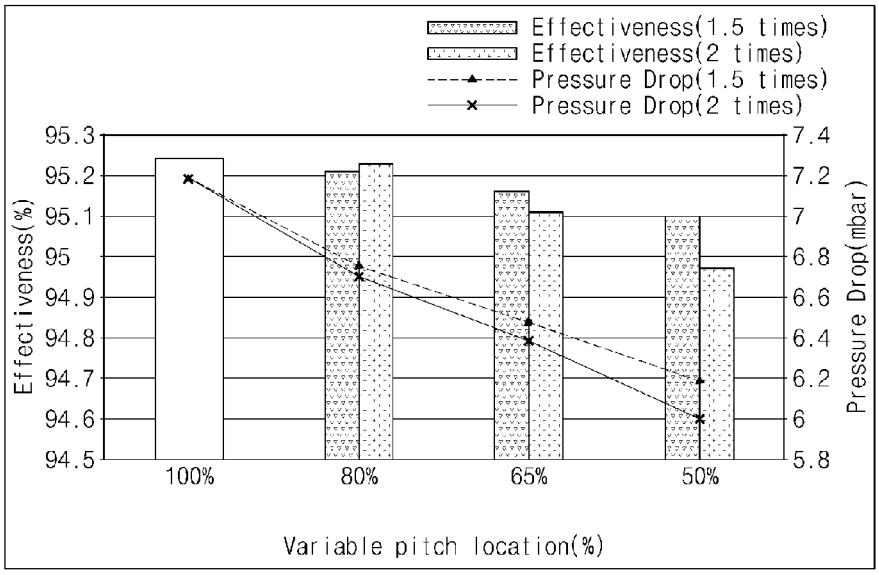
FIG. 7 is a graph for comparatively describing gas pressure difference and efficiency between the heat exchanger using the wave fin plate that includes the wave fin having the variable pitch section according to the present invention, and a heat exchanger using the wave fin plate that includes the wave fin having the fixed pitches.

FIG. 1 is a perspective view for describing an exhaust gas heat exchanger for an EGR system according to an embodiment of the present invention; FIG. 2 is an exploded perspective view of a heat exchanger body shown in FIG. 1; FIG. 3 is an enlarged perspective view of a wave fin plate removed from the heat exchanger body shown in FIG. 2; FIGS. 4(*a*) and 4(*b*) are perspective views for comparatively describing the wave fin plate that includes a wave fin having a variable pitch section according to the embodiment of the present invention, and a wave fin plate that includes a wave fin having fixed pitches according to the related art; FIG. 5 is a view showing a fixed pitch section of the wave fin plate and the variable pitch section according to the embodiment of the present invention; FIG. 6 is a view for describing a relation between curvature radii of adjacent waveform parts within the variable pitch section of the wave fin plate according to the embodiment of the present invention; and FIG. 7 is a graph for comparatively describing gas pressure difference and efficiency between the heat exchanger using the wave fin plate that includes the wave fin having the variable pitch section according to the present invention, and a heat exchanger using the wave fin plate that includes the wave fin having the fixed pitches.

First, referring to FIG. 1, the exhaust gas heat exchanger is applied to an exhaust gas recirculation (EGR) system, in which the EGR system increases concentration of $CO_2$ in intake air by recirculating a portion of exhaust gas to an intake system, thereby decreasing temperature of a combustion chamber, and thus reducing NOx. The heat exchanger includes: the heat exchanger body 1 for cooling the exhaust gas by heat exchange between the exhaust gas and a coolant; a gas inlet 2 for introducing exhaust gas into the heat exchanger body 1; a coolant inlet 3 for introducing the coolant into the heat exchanger body 1; a gas outlet 4 for discharging the exhaust gas that is cooled by heat exchange with the coolant; and a coolant outlet 5 for discharging the coolant that completes heat exchange with the exhaust gas.

Next, referring to FIG. 2, the heat exchanger body 1 includes: a laminated tube core 10 provided along a longitudinal direction of the heat exchanger body, the laminated tube core having an approximate parallelepiped shape; and a housing 20 formed so as to enclose the laminated tube core 10 except for opposite ends thereof, the housing having a shape of a rectangular box. The housing 20 includes: a first housing cell 21 formed so as to cover opposite sides of the laminated tube core 10 and an upper part thereof, the first housing cell having an approximate ⊂-shaped cross-section; and a second housing cell 22 combined with the first housing cell 21 to finish an open part of a lower end of the first housing cell 21, the second housing cell having the ⊂-shaped cross-section.

The first and the second housing cells 21, 22 may be manufactured by cutting and bending a thin metal plate that can be embossed. The laminated tube core 10 is formed by horizontally laminating a plurality of gas channels 11 side by side.

Each of the gas channels 11 may be manufactured to have an exhaust gas passage of an approximate quadrangular cross-section in such a manner that a first tube plate and a second tube plate having a ⊂-shaped cross-section and a cross-section symmetrical thereto respectively by being bent so as to be opposed to each other are overlapped at side walls (or flanges) thereof, and then are joined by brazing.

Each of the gas channels 11 is provided with the exhaust gas passage through which the exhaust gas passes in each of the gas channels, and the heat exchanger body 1 includes the wave fin plate 12 installed in the exhaust gas passage of each of the gas channels 11. The wave fin plate 12 is an element that has a main feature in the heat exchanger of the present invention, and significantly contributes to increasing a performance of the exhaust gas heat exchanger by causing turbulence of exhaust gas, and increasing a heat transfer area of the exhaust gas. Main elements and features of the wave fin plate 12 will be described in detail hereinbelow. Meanwhile, the adjacent gas channels 11 are provided with a coolant passage therebetween.

In addition, the heat exchanger body 1 may include two sets of tube holding plates on the opposite ends of the laminated tube core 10, the tube holding plates defining positions of the gas channels 11 of the laminated tube core 10. Furthermore, each of the sets of tube holding plates includes: a first tube holding plate 31, and a second tube holding plate 32 laminated on a front surface of the first tube holding plate 31. The first and second tube holding plates 31, 32 are provided with tube insert holes into which the gas channels 11 are inserted.

Referring to FIG. 3, the wave fin plate 12 is integrally provided with a plurality of wave fins 121*a*, 121*b* along a width direction thereof, and the plurality of wave fins 121*a*, 121*b* (commonly referred to as 121) include the wave fin 121*a* of an approximate groove-shaped cross-section, or a ∪-shaped cross-section, and the wave fin 121*b* of a convex cross-section, or a ∩-shaped cross-section that are adjacent to each other, or arranged in series. In addition, each of the plurality of the wave fins 121 is provided with groove parts and ridge parts having gentle parabolic shapes arranged in series in a longitudinal direction thereof, wherein the groove parts and ridge parts have approximate undulating shapes, waveforms, or sine curve shapes. The wave fin plate 12 is formed of a metal plate by forming selected from press forming, gear forming, and a combination thereof, and is integrally joined to the laminated tube core therein by joining selected from welding, soldering, adhesion, and a combination thereof.

The metal plate forming the wave fin plate 12 may be made of an austenitic stainless steel of any one selected from SUS 304, SUS 304L, SUS 316, and SUS 316L, and may have a thickness of 0.05 to 0.3 mm.

As shown in FIG. 3, FIG. 4(*a*), and FIG. 5, the wave fin 121 (121*a* or 121*b*) according to the embodiment of the present invention is configured to change in pitch along the longitudinal direction thereof, and is configured to have greater pitches at a gas outlet side than at a gas inlet side of the heat exchanger. Accordingly, the exhaust gas forms vortices while hitting waveforms of the wave fin 121 (121*a* or 121*b*), and then as the exhaust gas approaches the gas outlet side having waveforms with long pitches, forces of the vortices decrease, which contributes to reducing the gas pressure difference.

As shown in FIG. 4(*b*), the wave fin 121' of the wave fin plate of the related art has same size of pitches in the entire length thereof from the gas inlet side to the gas outlet side, thereby having a limitation in reducing the gas pressure difference.

As shown in FIG. 5, the wave fin 121 includes: the fixed pitch section A having a fixed pitch a from a position of the gas inlet to an approximate middle position indicating a position of 40% of the entire length of the wave fin 121; and the variable pitch section B having variable pitches b, c from the middle position to a position of the gas outlet.

In the embodiment of the present invention, the variable pitch section B is provided between a position indicating 40 to 90% of an entire length of the heat exchanger from the position of the gas inlet, and the position of the gas outlet. That is, the variable pitch section B is provided from a position indicating 40 to 90% of the entire length of the wave fin 121 from the position of the gas inlet to the position of the gas outlet. In this case, the fixed pitch section A is provided from the position of the gas inlet to the position indicating 40 to 90% of the entire length of the wave fin 121.

In this case, the fixed pitch section A occupies 40 to 90% of the entire length of the wave fin plate 12 or the wave fin 121, and the variable pitch section B occupies 10 to 60% of the entire length of the wave fin plate 12 or the wave fin 121.

In addition, it is preferred that a first pitch b of the variable pitch section B is 1.1 to 2.5 times greater than the fixed pitch a of the fixed pitch section A. Furthermore, a pitch in the variable pitch section B may gradually change, and preferably, a following pitch of succeeding pitches within the variable pitch section B increases by 1.2 to 1.8 times, more preferably, 1.5 times greater than a pitch of a preceding section. In this case, it is preferred that each of the wave fins 121 is configured to be within 3 to 8 mm in all of the pitches. In addition, the pitch of the wave fin is determined by a distance between tops of two waveform parts (a groove part or a ridge part), and as shown in FIG. 6, each of the waveform parts has a curvature radius R1 or R2. In this case, it is preferred that the curvature radius R2 of a following waveform part is configured to be 1.5 to 3 times greater than the curvature radius R1 of a preceding waveform part. Further, the wave fin constantly has a predetermined height H, and preferably, the height H (referring to FIG. 3) is approximately 4 to 8 mm.

In addition, all the pitches within the variable pitch section B of the wave fin 121 may be configured to be same or different each other. For example, the pitch of the wave fin 121 may be configured to gradually increase or decrease as the pitch of the wave fin approaches the position of the gas outlet that is a finishing point from a starting point of the variable pitch section B.

FIG. 7 is a graph showing a condition and result of an experiment for measuring the gas pressure difference and efficiency by designing different pitches of the wave fin of the wave fin plate.

Referring to FIG. 7, 100% of the graph denotes a case using fixed pitches as basic pitches applied to all pitches according to the related art, and 80% (a first embodiment), 65% (a second embodiment), and 50% (a third embodiment) denote cases that use fixed pitch sections corresponding to 80%, 65%, and 50% of the entire length of the wave fin 121 as sections of basic pitches, and use sections of remaining lengths of the wave fin as variable pitch sections that have pitches 1.5 or 2 times greater than the basic pitches.

Referring to the above description, as in the first embodiment, the second embodiment, and the third embodiment, compared to the case in which the fixed pitch section occupies 100%, the case in which each of the variable pitch sections is provided shows similar heat exchange efficiency and a drastic reduction of the gas pressure difference.

When the variable pitch section is more than 60% of the entire length, or when the fixed pitch section is less than 40% of the entire length, efficiency is greatly reduced, and when the variable pitch section is less than 10% of the entire length, or when the fixed pitch section is more than 90% of the entire length, it is impossible to obtain effect of a desired gas pressure difference reduction. Accordingly, it is the most advantageous that the variable pitch section of 10~60% of the entire length of the wave fin is arranged near the gas outlet side.

The invention claimed is:

1. A heat exchanger comprising:

a heat exchanger body; a gas inlet for introducing exhaust gas into the heat exchanger body; a coolant inlet for introducing a coolant into the heat exchanger body; a gas outlet for discharging the exhaust gas that is cooled by heat exchange with the coolant; and a coolant outlet for discharging the coolant that completes heat exchange with the exhaust gas, wherein the heat exchanger body comprises:

a laminated tube core formed by laminating a plurality of gas channels side by side;

a housing formed so as to enclose the laminated tube core except for opposite ends thereof; and a wave fin plate integrally provided with a plurality of wave fins and arranged within each of the gas channels, the wave fins having a wave fin of a ∪-shaped cross-section and a wave fin of a ∩-shaped cross-section that are arranged in series along a width direction of the wave fin plate, wherein each of the wave fins includes a fixed pitch section adjacent to a position of the gas inlet, and a variable pitch section adjacent to a position of the gas outlet along a longitudinal direction of the wave fin, each of pitches within the variable pitch section of the wave fin being always greater than each of pitches within the fixed pitch section of the wave fin, and the variable pitch section occupying 10 to 60% of a total length of the wave fin plate.

2. The heat exchanger of claim 1, wherein in each of the wave fins, a first pitch of the variable pitch section is 1.1 to 2.5 times greater than a fixed pitch of the fixed pitch section.

3. The heat exchanger of claim 2, wherein the variable pitch section includes a plurality of sections in which a pitch gradually increases by 1.2 to 1.8 times greater than a pitch of a preceding section.

4. The heat exchanger of claim 2, wherein the pitch of the variable pitch section of the wave fin is configured to gradually increase as the pitch of the variable pitch section approaches a position of the gas outlet.

5. The heat exchanger of claim 2, wherein the pitches of the variable pitch section of the wave fin are configured to be same each other.

6. The heat exchanger of claim 1, wherein the pitch of the variable pitch section of the wave fin is configured to gradually decrease as the pitch of the variable pitch section approaches a position of the gas outlet.

7. The heat exchanger of claim 1, wherein the wave fin comprises: a first waveform part, and a second waveform part positioned to follow the first waveform part in series such that the second waveform part defines a predetermined pitch between the first waveform part and the second waveform part, the first waveform part having a first curvature radius, and the second waveform part having a second curvature radius 1.5 to 3 times greater than the first curvature radius.

8. The heat exchanger of claim 1, wherein each of the wave fins is configured to have a predetermined height of 4 to 8 mm.

9. The heat exchanger of claim 1, wherein each of the wave fins is configured to be within 3 to 8 mm in all of the pitches.

10. The heat exchanger of claim 1, wherein the wave fin plate is formed of a metal plate by forming selected from press forming, gear forming, and a combination thereof, and is integrally joined to the laminated tube core therein by joining selected from welding, soldering, adhesion, and a combination thereof.

11. The heat exchanger of claim 10, wherein the metal plate forming the wave fin plate is made of an austenitic stainless steel of any one selected from SUS 304, SUS 304L, SUS 316, and SUS 316L, and has a thickness of 0.05 to 0.3 mm.

* * * * *